United States Patent [19]

Swain

[11] 4,172,625

[45] Oct. 30, 1979

[54] DRAWER EXTENDERS

[75] Inventor: C. Daniel Swain, Tacoma, Wash.

[73] Assignee: Comerco, Inc., Tacoma, Wash.

[21] Appl. No.: 861,018

[22] Filed: Dec. 15, 1977

[51] Int. Cl.[2] ..... A47B 88/00

[52] U.S. Cl. ..... 312/330 R; 312/333; 312/348

[58] Field of Search ..... 312/330 R, 333, 334, 312/335, 350, 348, 233, 345, 336, 339, 341 R; 308/316, 318

[56] References Cited

U.S. PATENT DOCUMENTS

| | | | |
|---|---|---|---|
| 886,192 | 4/1908 | Decanio | 312/333 |
| 2,560,721 | 7/1951 | Gibson | 312/233 |
| 2,614,022 | 10/1952 | Kurtzon | 312/348 |
| 2,655,422 | 10/1953 | Gussack | 312/333 |
| 2,981,584 | 4/1961 | Friend | 312/341 R |
| 3,092,429 | 6/1963 | Barnes | 312/333 |
| 3,409,257 | 11/1968 | Elm | 248/205 A |
| 3,488,097 | 1/1970 | Fall | 312/339 |
| 3,616,096 | 10/1971 | Roeder | 248/205 A |

FOREIGN PATENT DOCUMENTS

| | | | |
|---|---|---|---|
| 849145 | 9/1960 | United Kingdom | 312/335 |

*Primary Examiner*—Victor N. Sakran
*Attorney, Agent, or Firm*—Gipple & Hale

[57] ABSTRACT

A drawer extender assembly comprising a pair of cabinet rails which are removably secured to the internal walls of a cabinet structure. The cabinet rails are provided with a floating rail guide positioned toward the front of the cabinet rail on which a floating rail member slides. Each floating rail member comprises an integral member defining two C-shaped channels having a common back for at least a portion of their height. One of the C-shaped channels is adapted to fit over and slide upon a horizontally extending floating rail guide and is provided with a vertically-extending pin located towards the rear of the channel adapted to abut against the rear surface of the floating rail guide when the floating rail members are fully extended and the other C-shaped channel is adapted to receive a drawer slide which is secured to a drawer; the other channel being provided with a vertically-extending pin located towards the front of the channel acting as a stop by abutting against the leading edge of a drawer slide when the drawer is fully extended. Each of the door slides is horizontally slidable on each of the floating rails.

6 Claims, 7 Drawing Figures

DRAWER EXTENDERS

BACKGROUND OF THE INVENTION

This invention relates to an apparatus which comprises a pair of assemblies adaptable to being secured to the sides of a storage unit. The cabinet or other storage unit is ordinarily provided with a plurality of drawers; the assemblies referred to herein serve to extend the drawers beyond the ordinary extension allowed by the storage unit. More specifically, the present invention comprises a pair of assemblies which are secured within a cabinet or storage unit. The assemblies matingly receive a drawer guide which is secured to the side walls of a drawer held within the storage unit. Without the use of the present invention, the drawer held within the cabinet or storage unit can only be withdrawn or extended from within the cabinet a distance somewhat less than the length of the drawer. The present invention, however, allows the drawer to be fully withdrawn from the storage unit and yet held in a horizontal position and capable of being totally replaced into the storage unit or cabinet without the need of realigning the drawer with the support rails of the cabinet or storage unit.

DESCRIPTION OF THE PRIOR ART

Many storage arrangements, such as vertical file cabinets, are provided with drawer extenders. These drawer extenders serve to allow the user of the file cabinet to fully withdraw the particular drawer desired from the confines of the storage or file cabinet. By totally withdrawing the drawer from the file cabinet, the user or operator is given greater access to all parts of the drawer. The drawer extenders, previously described, are generally designed to allow the entire drawer held within the file cabinet to horizontally slide and then be held in a plane level with the position of the drawer when it is in its closed position. The prior art also discloses means for stopping the drawer or support surface from being totally withdrawn from the cabinet or storage unit.

The aforementioned vertical file cabinets, while being provided with drawer extender members, do not allow these extender members to be readily removed and reapplied to other storage or cabinet structures. These prior art drawer extenders are made for permanent installation. Conversely, the present invention disclosed herein teaches the use of a pair of assemblies which are adapted to be removably secured within any suitable storage or cabinet structure with a drawer slide also removably secured to a drawer such that any cabinet or storage unit will have the capability of allowing the drawer or support surface to fully extend beyond the front wall of the cabinet or storage unit.

The prior art drawer extenders are generally constructed of metal or preferably steel components and are provided with a plurality of ball bearings for facilitating the movement of the drawer. The invention disclosed herein, however, need not necessarily be constructed of a metal and, due to its simple construction and functional design, is not provided with ball bearings, thereby substantially eliminating any problems and costs inherent therein.

As previously mentioned, the present invention is adaptable for use with any cabinet or storage unit that contains drawer or other support members. The prior art merely discloses drawer extenders which are fixedly and permanently secured within the cabinet or file cabinet structure for use with only that particular structure. However, drawer extenders which allow a drawer to be completely withdrawn from a cabinet or storage unit while still supporting the drawer or support surface, are useful and desirable in a variety of situations.

SUMMARY OF THE INVENTION

The present invention comprises a pair of assemblies which are removably secured to the inside walls of a cabinet or storage unit. A cabinet rail is provided which is removably secured in a horizontal, parallel fashion beneath the guide rails of the cabinet or storage unit. The cabinet rail slideably receives a floating rail. The floating rail is adapted to slide along the cabinet rail and on its other side serves to allow a drawer slide to slide within it. The drawer slide is removably secured to the side of a drawer or other support surface. In this manner, it can be seen that the floating rail will slide along the cabinet rail while the drawer slide, attached to a drawer, slides within another channel provided by the floating rail and, therfore, the entire apparatus serves to extend the distance that the drawer may be withdrawn from the cabinet or storage unit. The floating rail is provided with a pair of stopping pins which serves to prevent the inadvertent total withdrawal of the drawer or tray.

The construction, operation and advantages of the present invention will become more readily apparent and understood from the following detailed specification accompanying the drawings in which:

DETAILED DESCRIPTION OF THE DRAWINGS

Figures 1, 2, 3:
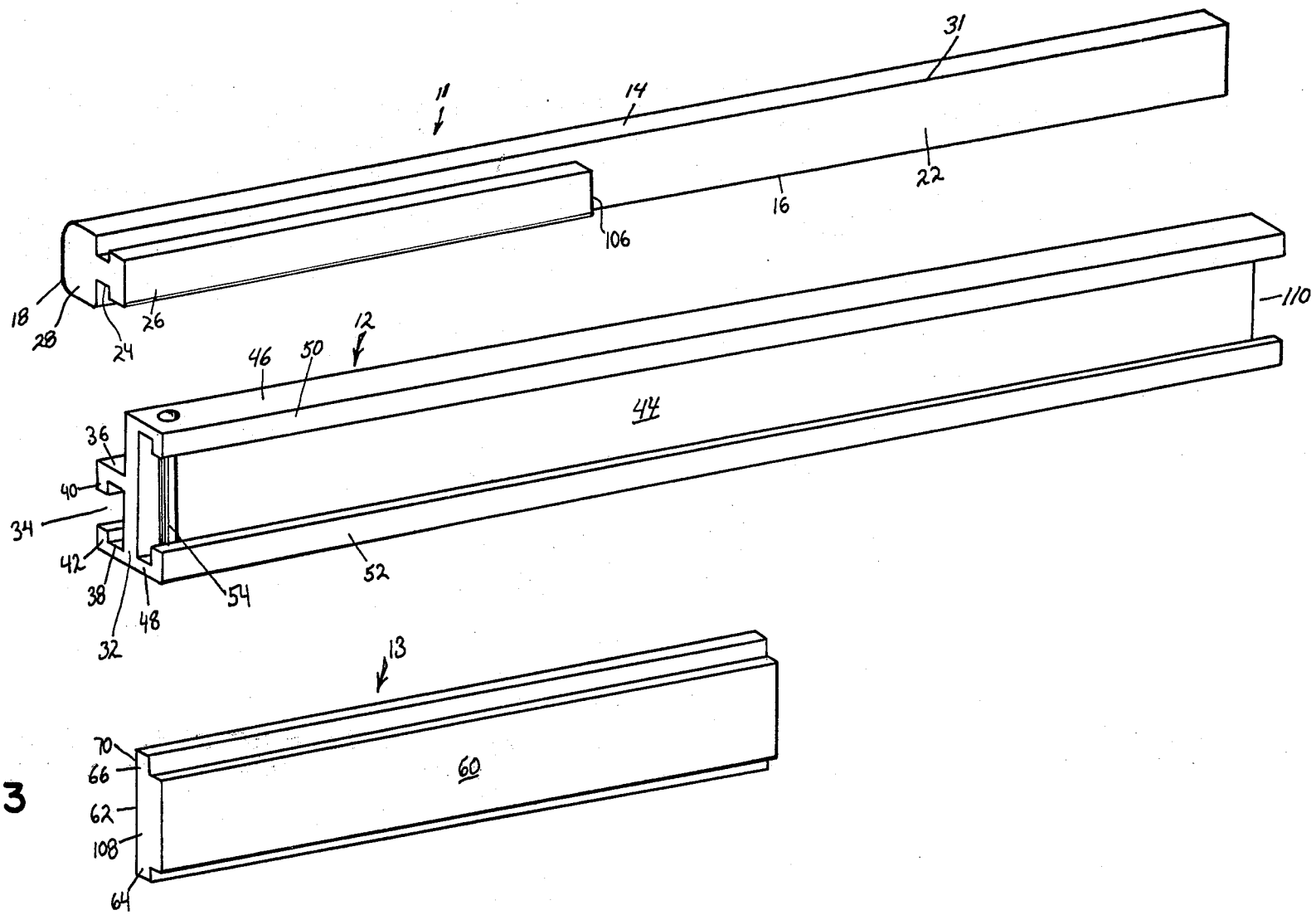
FIG. 1 is a perspective view of the cabinet rail.
FIG. 2 is a perspective view of the floating rail.
FIG. 3 is a perspective view of the drawer slide.

A cabinet rail 11, as best shown in FIG. 1, is adapted to be removably secured to the interior side wall of a cabinet or other storage unit. The cabinet rail 11 may be provided with a plurality of holes or apertures or conventional fastening means, e.g., nails or wood screws. In the preferred embodiment, however, the cabinet rail 11 is adhesively secured by a dissoluble glue to the interior side wall of a cabinet structure 20. It will be appreciated that description of the cabinet rail 11, floating rail 12, and drawer slide 13, is identical to the cabinet rail, floating rail and drawer slide which must be provided on the other side of a drawer 25. A duplicate pair of each assembly comprising the cabinet rail, floating rail and drawer slide is required in order for the system to operate. However, as the assemblies are mirror images of one another, description of one of the assemblies will suffice to describe the other.

Figures 6, 7:
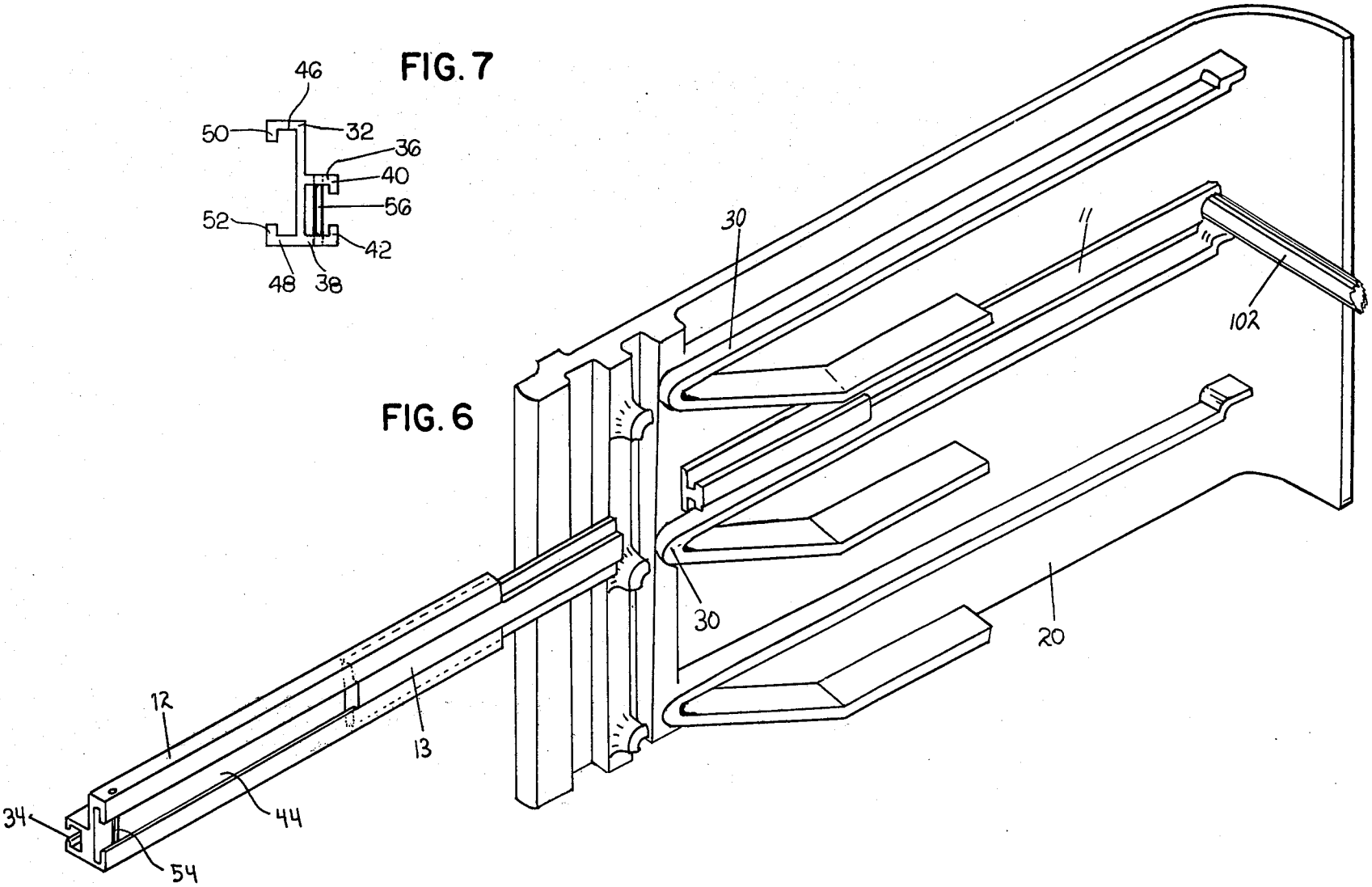
FIG. 6 is a partial perspective view of the interior of a cabinet with an extended view of the floating rail and drawer slide.
FIG. 7 is a cross-sectional view of FIG. 2 taken along line a'—a'.

The cabinet rail comprises a longitudinal section 31 which is provided with a large surface area in order to facilitate the attachment of the cabinet rail to the interior of the cabinet structure 20. The longitudinal section 31 of the cabinet rail 11 comprises a top surface 14, a bottom surface 16, cabinet wall contact surface 18, and side planar surface 22. The cabinet wall contact surface 18 of longitudinal section 31 of the cabinet rail is adapted to be removably secured to the inside vertical wall surface of the cabinet structure 20. As previously mentioned, the cabinet wall contact surface 18 is provided with a relatively large surface area in order to facilitate the attachment of the cabinet rail to the interior of the cabinet structure 20. While holes or apertures may be provided through the cabinet rail to facilitate fastening of the cabinet rail to the inside of the cabinet structure 20, the preferred embodiment contemplates the cabinet rail being adhesively secured by a dissoluble glue to the inside vertical wall of the cabinet structure. Extending interiorly from the side planar surface 22 of the longitudinal section 31 is a connecting flange 24 which serves to support the stationary floating rail guide 26. The stationary floating rail guide 26 extends only a portion of the entire length of the longitudinal section 31 and in the preferred embodiment extends one half of the length. The stationary floating rail guide 26 is always, however, provided at the front end 28 of the longitudinal section 31. As will be further described, the floating rail 12 is provided with a C-shaped channel which matingly slides over the stationary floating rail guide 26 and allows the floating rail to horizontally slide within and be withdrawn from the cabinet structure 20. While the exact placement of the cabinet rail will be determined by the particular structure of the cabinet to which the assemblies are sought to be applied, the preferred embodiment of the present invention contemplates the cabinet rail being adhesively secured beneath the ordinary drawer glide 30, the support surface for the drawer flanges which the cabinet structure 20 is ordinarily provided with. The particular orientation of the cabinet rail 11 with respect to the ordinary drawer glide 30 of the cabinet structure 20 can best be seen in FIG. 6.

The floating rail 12, as best seen in FIG. 2, comprises two C-channels which share a common vertical member 32. The length of the floating rail 12 is substantially identical to the length of the longitudinal section 31 of the cabinet rail 11. Smaller C-channel 34 comprises vertical member 32, horizontal top surface 36, horizontal bottom surface 38, downwardly directed flange 40, and upwardly directed flange 42. The smaller C-channel 34 of the floating rail 12 slideably receives the stationary floating rail guide 26 of the cabinet rail 11. In this manner, the floating rail 12 will horizontally extend from the cabinet structure 20.

The larger C-channel member 44 of the floating rail 12 comprises the common vertical member 32, the top planar surface 46, the bottom planar surface 48, the downwardly directed flange 50, and the upwardly directed flange 52. Located towards the front of the larger C-channel 44 is a vertical pin 54 which extends between top planar surface 46 and bottom planar surface 48. Similarly, located towards the rear of the smaller C-channel 34 of the floating rail 12 is a second vertical pin 56 which extends between the top surface 36 and bottom surface 38 of the smaller C-channel 34.

Figure 5:
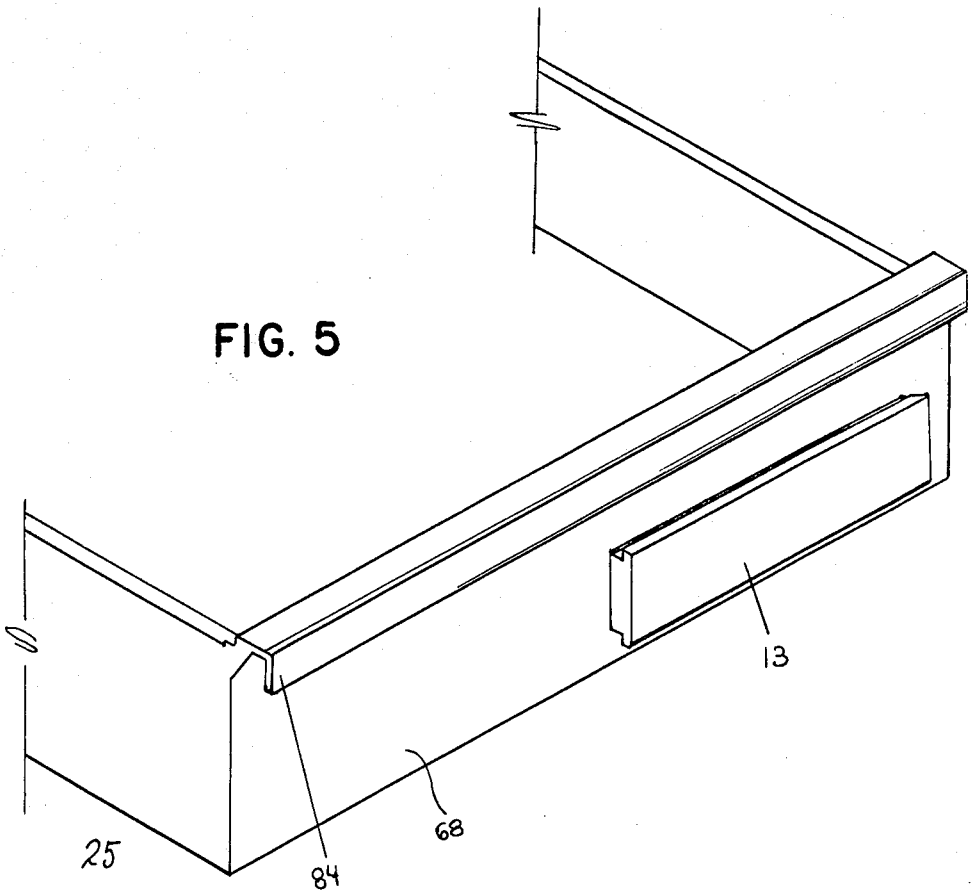
FIG. 5 is a partial perspective view of a drawer with a drawer slide attached thereto.
Figure 4:
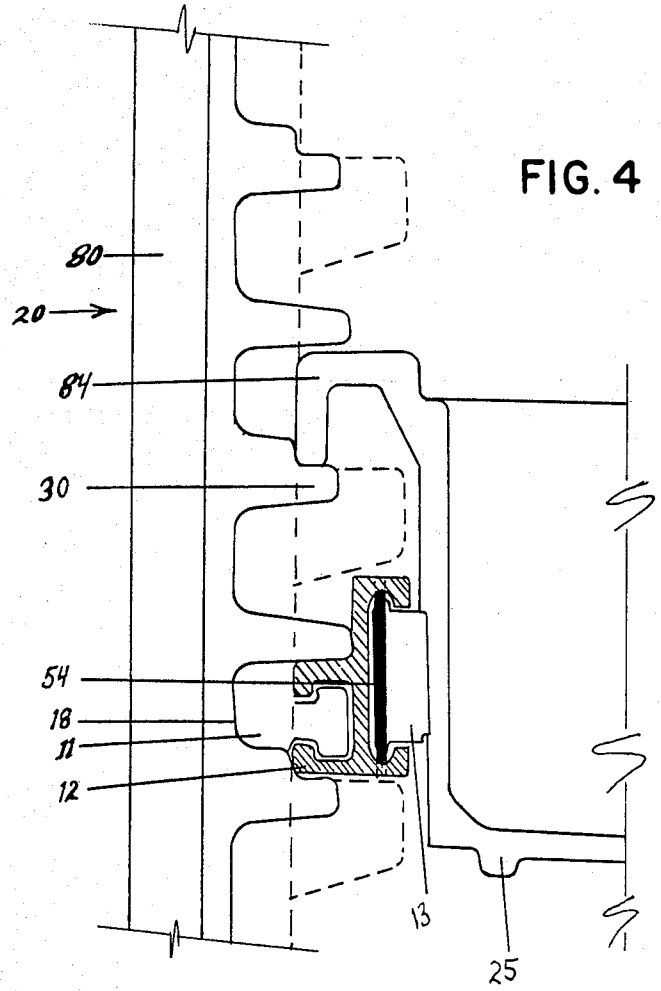
FIG. 4 is a frontal cross-sectional view, partially in section, of a storage unit side wall, with the extender rail assembly in operation and a drawer or other support unit also being shown.

As best seen in FIG. 3, the drawer slide 13 comprises a drawer contact surface 60 and sliding member 62. Sliding member 62 is further comprised of two vertically extending flanges 64 and 66. The drawer slide 13 may be provided with holes or apertures to facilitate the selective securement of the drawer slide to the side of a drawer 25. In the preferred embodiment, however, the drawer slide is adhesively secured or glued to the side wall 68 of the drawer 25. As best seen in FIG. 5, the drawer slide is adhesively secured to the rear trailing portion of the side wall 68 of the drawer 25. The drawer contact surface 60 is preferably of a relatively large surface area in order to facilitate the attachment of the drawer slide to the side wall 68 of the drawer 25. The sliding member 62, previously described as being comprised of vertically extending flanges 64 and 66, is of a sufficient height so as to be slideably received and held within the larger C-channel 44 of the floating rail 12. It will be appreciated that the vertically extending flanges 64 and 66 of the drawer slide 13 extend into the cavities formed by the top planar surface 46, bottom planar surface 48, downwardly directed flange 50, and upwardly directed flange 52. The side of the drawer slide 13 opposite the drawer contact surface 60 is a flat vertical surface 70.

In order to fully understand the operation of the present invention, a brief description of the cabinet structure 20 and a typical drawer 25 removably secured therein will be undertaken. A typical cabinet structure 20 is provided with vertical internal walls 80 which are further provided with drawer glides 30. Often times the drawer glides 30 of the cabinet structure 20 are integrally molded with the vertical internal walls 80 as shown in the drawings. The drawer glides 30 of the cabinet structure 20 provide horizontal sliding support surfaces for a drawer 25. Typically, the drawer 25 is provided on its sides with outwardly extending flanges 84. These outwardly extending flanges 84 are adapted to glide over the drawer glides 30 of the cabinet structure 20. Thus it can be seen that the drawer 25 may be selectively withdrawn from or replaced within the internal cavity of the cabinet structure 20. However, the drawer can only be supported by the cabinet structure when a substantial part of the outwardly extending flanges 84 of the drawer 25 rest upon the drawer glides 30.

In order to use the present invention in an existing conventional cabinet structure, a pair of drawer extending assemblies 100 each comprising the cabinet rail 11, floating rail 12, and drawer slide 13 must be utilized. Prior to the securement of the cabinet rails 11 to the vertical internal walls 80, the floating rail 12 must be slid upon the stationary floating guide 26, i.e., the smaller C-channel 34 must be slid over the stationary floating rail guide 26. This is accomplished by the leading edge 104 of the floating rail 12 being slid onto the rear surface 106 of the stationary floating guide 26. This is the only way that the floating rail 12 may be slid onto the stationary floating rail guide 26 due to the placement of the second vertical pin 56 towards the rear of the smaller C-channel 34. Additionally, and also prior to the installation of the cabinet rails 11, the drawer slides 13 must be adhesively secured to the side walls 68 of the drawers 25. After the attachment of the drawer slides 13 to the drawers 25, the leading edge 108 of the drawer slide 13 must be slid within the larger C-channel 44 of the drawer slide 13. The leading edge 108 of the drawer slide 13 must be placed into the rear opening 110 of longer C-channel 44. Here again, this is the only way for proper assembly due to the position of the vertical pin 54 of the larger C-channel. As previously mentioned, the drawer slide 13 is preferably secured towards the rear of the side wall 68 of the drawers 25. With the assembly 100 prepared as just mentioned, the cabinet rails 11 may be adhesively secured or conventionally fastened to the internal walls 80 of the cabinet structure 20. As previously mentioned, the preferred embodiment of the invention contemplates the cabinet rail 11 being secured beneath the drawer glides 30. A horizontally extending cylindrical pole 102 may be secured to the rear surfaces of the side planar surfaces 22 of the cabinet rails in order to facilitate the placement of the cabinet rails in parallel relation.

Operation of the drawer extender assemblies can now be fully explained. With the drawer held within the cavity of the cabinet structure 20, the outwardly extending flanges 84 glide upon the drawer glides 30. When the operator desires to partially remove the drawer from the cabinet structure 20, he merely glides the drawer upon the drawer glide surfaces 30. However, when the operator desires to totally withdraw the drawer from within the cabinet structure 20 yet also desires to have the drawer horizontally supported after complete removal of the drawer, the outwardly extending flanges 84 of the drawers 25 will no longer be supported upon the drawer glides 30. Without the use of the drawer extenders 100, the drawers 25 would not be supported as desired. However, with the drawer extender assemblies 100 installed as just described, when the operator desires to totally remove the drawer while maintaining horizontal and vertical stability of the drawer, the floating rail 12, i.e., the smaller C-channel 34, slides along the stationary floating rail guide 26 of the cabinet rail 11. Additionally, the drawer slide 13 slides within the larger C-channel 44 of the floating rail 12 while still being fixedly secured to the side wall 68 of the drawer 25. Thus it can be seen that the drawer 25 can be totally withdrawn from the cavity of a cabinet structure 20 and still be supported in a vertical and horizontal position without the need of the outwardly extending flanges 84 of the drawer 25 being supported upon the drawer glides 30 of the cabinet structure 20.

In order to prevent inadvertent total withdrawal of the floating rail 12 or the drawer slide 13 from the floating rail 12, the larger C-channel vertical pin 54 and second vertical pin 56 have been provided. In operation, the floating rail 12 is prevented from being totally withdrawn from the stationary floating rail guide 26 when the second vertical pin 56 of the smaller C-channel 44 abuts against the rear surface 106 of the stationary floating rail guide 26. Similarly, the drawer slide 13 is precluded from being inadvertently totally withdrawn from the floating rail 12 by the placement of the larger C-channel vertical pin 54. When the leading edge 108 of the drawer slide 13 abuts against the larger C-channel vertical pin 54 of the floating rail 12, the drawer slide and consequently the drawer 25 is prevented from further removal. It will be appreciated that the degree of removal of a particular drawer 25 is dependent upon several parameters which may be selectively altered as desired. More specifically, changing the length of the stationary floating rail guide 26, location of the second vertical pin 56, location of the larger C-channel vertical pin 54, and length and position of the drawer slide 13 with respect to the side wall 68 of drawer 25 will result in the drawer being capable of being removed different distances.

When it is desired to remove the drawer extender assemblies 100 from the storage or cabinet structure 20, it is merely necessary for the operator to unfasten or unglue the cabinet rail 11 from the vertical internal walls 80 of the cabinet structure. The drawer extender assemblies and drawer can then be removed from the cabinet structure and the drawer slide 13 subsequently removed from the side wall 68 of the drawer 25. The drawer extender assemblies 100 can then be subsequently secured to another drawer for use in another cabinet structure.

While the preferred embodiment of the invention has been disclosed, it is understood that the invention is not limited to such an embodiment since it may be otherwise embodied in the scope of the appended claims.

What is claimed is:

1. A drawer extender assembly comprising a pair of cabinet rails being removably securable to vertical internal walls of a cabinet structure by fastening means, a pair of floating rails, each cabinet rail being provided with a floating rail guide positioned toward the front of the cabinet rail upon which the floating rails slide, said floating rail guides longitudinally extending a distance not greater than one-half the length of the cabinet rails, said floating rails comprising two C-shaped channels having common backs for at least portions of their height, one of said C-shaped channels being adapted to fit over and slide upon a horizontally extending floating rail guide of said cabinet rails, said one C-shaped channel being provided with stop means adapted to abut against the rear surfaces of said floating rail guides when said floating rail guides are fully extended, said stop means comprising a vertically extending pin located towards the rear of said one C-shaped channel, and the other C-shaped channel adapted to slideably receive said drawer slides, said other C-shaped channel being provided with stop means adapted to abut against the leading edge of said drawer slides when said drawer is fully extended, said stop means comprising a vertically extending pin located towards the front of said other C-shaped channel, and a pair of drawer slides, said drawer slides being removably securable to the side walls of a drawer by said fastening means, said drawer slides being less than one-half the length of said side walls of the drawer to which they are fastened, each of said drawer slides being horizontally slideable on each of said floating rails.

2. A drawer extender assembly as claimed in claim 1 wherein said fastening means is a removable adhesive.

3. A drawer extender assembly comprising a pair of cabinet rails removeably securable to vertical internal walls of a cabinet structure by fastening means, a pair of floating rails, each cabinet rail being provided with a floating rail guide positioned toward the front of the cabinet rail upon which a floatinhg rail slides, said a floating rail guide longitudinally extending a distance not greater than one-half of a length of the cabinet rails, said floating rails comprising an integral member defining two different sized C-shaped channels formed with a common back for at least a portion of their height, one of said C-shaped channels being adapted to fit over and slide upon a horizontally extending floating rail guide of said cabinet rail, said one C-shaped channel being provided with stop means adapted to abut against the rear surface of a floating rail guide when said floating rails are fully extended, said stop means comprising a vertically extending pin located towards the rear of said one C-shaped channel, and the other C-shaped channel adapted to slidably receive a drawer slide, said other C-shaped channel being provided with a stop means adapted to abut against the leading edge of said drawer slide when said drawer is fully extended, said stop means comprising a vertically extending pin located towards the front of said other C-shaped channel and a pair of drawer slides, said drawer slides being removeably securable to the side walls of a drawer by fastening means, said drawer slides being less than one-half of the length of said side walls of the drawer to which they are fastened, each of said drawer slides being horizontally slidable in each of said floating rails.

4. A drawer extender assembly as claimed in claim 3 wherein said floating rail guides are "T-shaped" extensions which slidably mate in the floating rail channel and which serve to support the floating rail guide.

5. A drawer extender assembly as claimed in claim 3 wherein the length of said floating rail member is substantially equal to the length of said cabinet rail member.

6. A drawer extender assembly as claimed in claim 3 wherein said cabinet rail defines an outer arcuate surface constructed to fit into an arcuate recess defined in said cabinet wall.

* * * * *